US006231171B1

(12) United States Patent
Yamashita et al.

(10) Patent No.: US 6,231,171 B1
(45) **Date of Patent: *May 15, 2001**

(54) METHOD FOR INSERTING OVER-SIZED ABSORBER INTO A CASE

(75) Inventors: Takashi Yamashita, Tokyo; Hiroshi Yanai, Kawasaki, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/446,234

(22) Filed: May 22, 1995

(30) Foreign Application Priority Data

May 26, 1994 (JP) ..... 6-112804

(51) Int. Cl.[7] ..... B41J 2/175
(52) U.S. Cl. ..... 347/86
(58) Field of Search ..... 347/86, 87; 29/451, 29/530

(56) References Cited

U.S. PATENT DOCUMENTS

| | | | | |
|---|---|---|---|---|
| 4,771,295 | | 9/1988 | Baker et al. | 347/87 |
| 5,025,271 | | 6/1991 | Baker et al. | 347/87 |
| 5,182,579 | * | 1/1993 | Haruta et al. | 347/87 |
| 5,280,299 | * | 1/1994 | Saikawa et al. | 347/87 |
| 5,319,841 | * | 6/1994 | Yata et al. | 29/451 |
| 5,400,067 | * | 3/1995 | Day | 347/87 |
| 5,509,140 | * | 4/1996 | Koitabashi et al. | 347/87 |

FOREIGN PATENT DOCUMENTS

| | | | | |
|---|---|---|---|---|
| 577439 | * | 1/1994 | (EP) | 347/87 |

* cited by examiner

*Primary Examiner*—N. Le
*Assistant Examiner*—Judy Nguyen
(74) *Attorney, Agent, or Firm*—Fitzpatrick, Cella, Harper & Scinto

(57) ABSTRACT

A method of inserting into a small-sized accommodating case an elastic body larger than the case by regulating the amounts the body is compressed in vertical and horizontal directions such that the elastic body adheres closely to the inner surface of the case without forming gaps therebetween and a distribution of dense and less-dense parts is generated in the inserted elastic body. First, the elastic body is compressed by pushing two sets of opposite side surfaces thereof by using two parallel clamping hands, respectively. Then, the compressed elastic body is inserted in the case. Subsequently, the elastic body is further compressed in the direction of the insertion. Thereby, the distribution of dense and less-dense parts can be generated in the elastic body without forming wrinkles therein and gaps between the elastic body and the inner surfaces of the ink tank. Consequently, ink supply capability can be raised and printing quality can be improved.

41 Claims, 11 Drawing Sheets

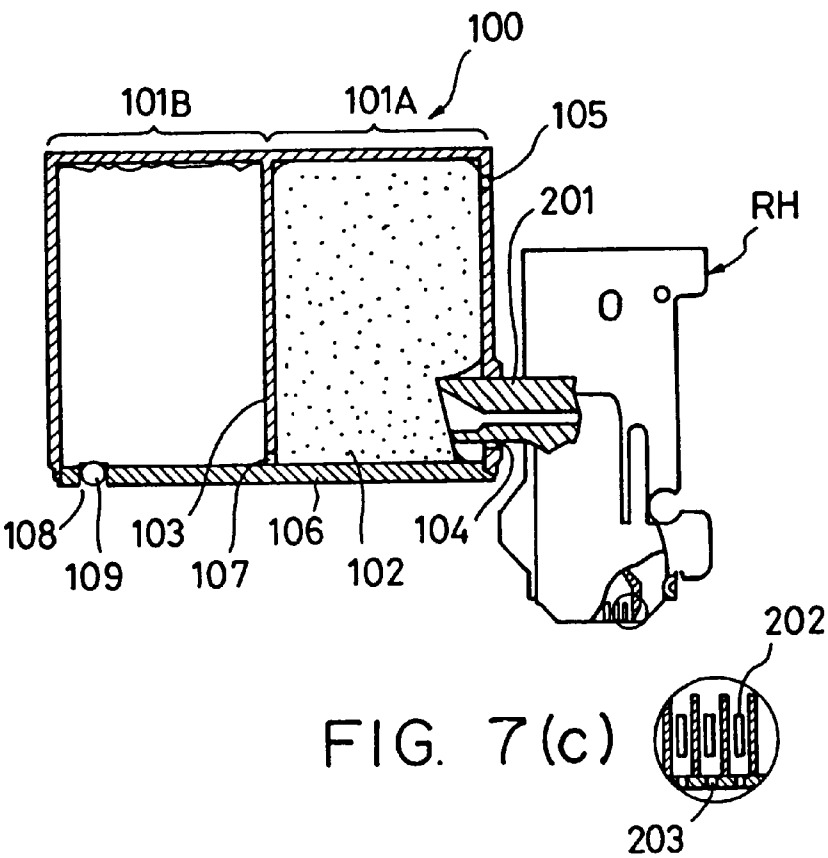
FIG. 7(b)
FIG. 7(c)
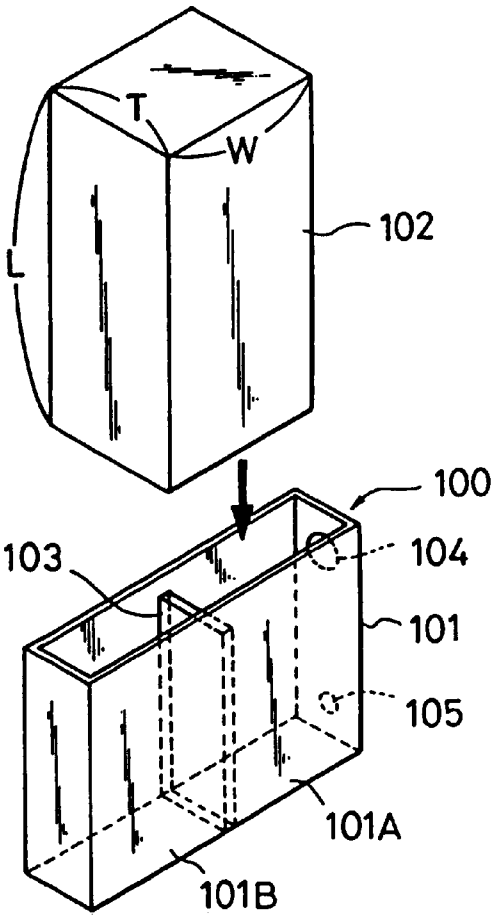
FIG. 7(a)

METHOD FOR INSERTING OVER-SIZED ABSORBER INTO A CASE

BACKGROUND OF THE INVENTION

1. Field of the Invention

The present invention generally relates to a method for inserting an absorber (hereunder sometimes referred to as a negative pressure producing material) into a case which accommodates the absorber. More particularly, the present invention relates to a method for inserting into an accommodating portion an absorber which is larger than the accommodating portion.

2 . Description of the Related Art

There has been developed a device into which a recording head and an ink tank are integrated for use as recording means in a small-sized ink jet recording apparatus. Further, such a device is detachably mounted on the apparatus to perform a recording operation. In the case of such a device, namely, an ink tank of the cartridge type into which a recording head and an ink tank are integrated, it is necessary to produce a predetermined negative pressure on the ink in the ink tank. A method for producing such a negative pressure is to insert an absorber into the ink tank and impregnate the absorber with ink.

For inserting absorbers into such an ink tank, a method of manually inserting preliminarily compressed absorbers thereinto one by one has been employed. Further, in this method, ink has been injected by an ink injector into the inserted absorbers. Manually inserting the absorbers in this manner takes much time and labor and is unsuitable for mass production. Moreover, unnecessary wrinkles have sometimes occurred in the absorbers when inserting them into the ink tank. Furthermore, occasionally a part of the absorber does not adhere closely to the inner surface of the ink tank. All in all, it is difficult to obtain consistent results when inserting the absorbers in accordance with this method.

When a wrinkle or a gap occurs in the absorber inserted in the ink tank as described above, a small pool of ink may be formed therein. Then, when a recording operation is performed, the ink collected in the small pool is not supplied to the recording head and thus is left in the ink tank. Further, such a pool of ink can obstruct ink flow, which results in degradation in the capability of supplying ink to the recording head. Moreover, sometimes ink is not normally discharged and printing quality may deteriorate.

To avoid an occurrence of such a state, a method of a jig to uniformly insert a compressed absorber into an ink tank has been developed. The absorber, which has been inserted into the ink tank after being uniformly compressed by the jig, does not cause the aforementioned small pool of ink. Accordingly, as ink is consumed by performing a printing operation, the ink in the uniformly compressed absorber is redistributed in the absorber. However, as the remaining quantity of ink in the absorber decreases, the negative pressure produced by the absorber increases. Thus, neither smooth movement nor sufficient supply of ink can be guaranteed. Moreover, the utilization ratio or efficiency of use of the in the uniformly compressed absorber tends to be low.

It is preferable for increasing the utilization efficiency of the ink in the absorber that the absorber compression gradually increase in inverse proportion to the distance from an ink supply opening of the recording head.

For example, U.S. Pat. No. 4,771,295 and No. 5,025,271 disclose that the capillary force of an absorber put into an ink tank is regulated in an ink jet cartridge in which a rib is provided in a portion thereof at an ink supply opening so as to regulate or increase the capillary force of the absorber at that location. Moreover, U.S. patent application Ser. No. 08/323,050 filed on Oct 14, 1994, now abandoned, discloses an absorber that has an enlarged shape that causes the absorber to be compressed when inserted in an ink tank so that the part of the absorber located in the vicinity of the ink supply opening is compressed in the proximity to the ink supply opening.

However, in the former method, variations in characteristics of mass-produced ink tanks may cause the efficiency of ink in such ink tanks to be unstable. In the latter method, when inserting the absorber into the ink tank, a wrinkle may occur in a region used to increase compressibility and the ink supply capability of the device thus may not be improved any way.

In any event, the aforementioned conventional absorber inserting methods may not suitably and accurately regulate the relation between (or the distribution of) dense and less-dense parts of the absorber inserted in the ink tank.

SUMMARY OF THE INVENTION

The present invention resolves the aforementioned problems of the prior art.

Accordingly, an object of the present invention is to provide a method for inserting an absorber into an ink tank, by which the absorber can be put into the ink tank with the distribution of dense and less-dense parts in the absorber regulated to improve ink supply capability.

To achieve the foregoing object, studies have been conducted and it has been learned that an absorber can be put into an ink tank by performing the following absorber inserting method such that a part of the absorber on the side of an insertion opening is dense and such that the other part thereof becomes less dense as the distance from the insertion opening increases. Namely, the absorber inserting method comprises the steps of first compressing the opposite surfaces of an absorber by means of a pair of jigs, and subsequently inserting the absorber into the ink tank, and next pressing down the absorber from above by means of pushing means and finally detaching the pair of jigs from the absorber. Moreover, it has been learned that in such case, the problems of the prior art hardly occur. The present invention is accomplished on the basis of the aforesaid knowledge.

In accordance with one aspect of the invention, a method for inserting a compressible absorber into a case smaller than the absorber comprises the steps of compressing first and second sets of opposite side surfaces of the absorber with first and second pressing members, respectively, each pressing member including opposing pressing elements for compressing corresponding opposite side surfaces of the absorber to dimensions smaller than corresponding dimensions of the case, inserting at least a portion of the absorber into the case, thereafter pressing another side surface of the absorber with a third pressing member to insert the absorber wholly within the case, and withdrawing the first and second pressing members out of the case while the third pressing member holds the absorber in the case.

In accordance with another aspect of the present invention, an ink tank comprises an ink absorber accommodating section having an open side through which an absorber is inserted into the accommodating section by compressing first and second sets of opposite side surfaces of the absorber with first and second pressing members, respectively, each pressing member including opposing pressing elements for compressing corresponding opposite side surfaces of the absorber to dimensions smaller than corresponding dimensions of the accommodating section, inserting at least a portion of the absorber into the case, thereafter pressing another side surface of said absorber with a third pressing member to insert said absorber wholly within the accommodating section, and withdrawing the first and second pressing members out of the accommodating section while the third pressing member holds the absorber therein, an ink containing section integral with the accommodating section and having a port communicating therewith, a lid secured to the open side to provide an ink-tight seal therewith, and an ink supply opening in the accommodating section for supplying ink to a recording head.

In accordance with yet another aspect of the present invention, an ink supply device comprises an ink tank with an ink absorber accommodating section having an open side through which an absorber is inserted into the accommodating section by compressing first and second sets of opposite side surfaces of the absorber with first and second pressing members, respectively, each pressing member including opposing pressing elements for compressing corresponding opposite side surfaces of the absorber to dimensions smaller than corresponding dimensions of the accommodating section, inserting at least a portion of the absorber into the case, thereafter pressing another side surface of said absorber with a third pressing member to insert the absorber wholly within said accommodating section, and withdrawing the first and second pressing members out of the accommodating section while the third pressing member holds the absorber therein, an ink containing section integral with the accommodating section and having a port communicating therewith and a lid secured to the open side to provide an ink-tight seal therewith, an ink supply opening in the accommodating section for supplying ink to a recording head, and an ink injection device including an ink injecting member for communicating with the ink containing section to introduce ink thereinto from outside the ink tank.

The present invention is effective to prevent local wrinkles and gaps in the inserted absorber. It is especially effective to press the absorber by a third pressing member while the side surfaces of the absorber are held by first and second pressing members, because wrinkles and gaps where the absorber contacts the inner surfaces of the case are inhibited. Consequently, a favorable distribution of dense and less-dense parts can be generated in the absorber and the ink supply capability of the device can be improved.

BRIEF DESCRIPTION OF THE DRAWINGS

Other features, objects and advantages of the present invention will become apparent from the following description of preferred embodiments with reference to the drawings in which like reference characters designate like or corresponding parts throughout several views, and in which:

FIG. 7(*a*) is a schematic diagram for illustrating the configuration of an ink tank to which the method for inserting an absorber according to the present invention is applied;

FIG. 7(*b*) is a schematic diagram for illustrating the configuration of a recording head fitted into the ink tank shown in FIG. 7(*a*);

FIG. 7(*c*) is a detail view of the recording head;

DETAILED DESCRIPTION OF THE PREFERRED EMBODIMENTS

Figure 1:
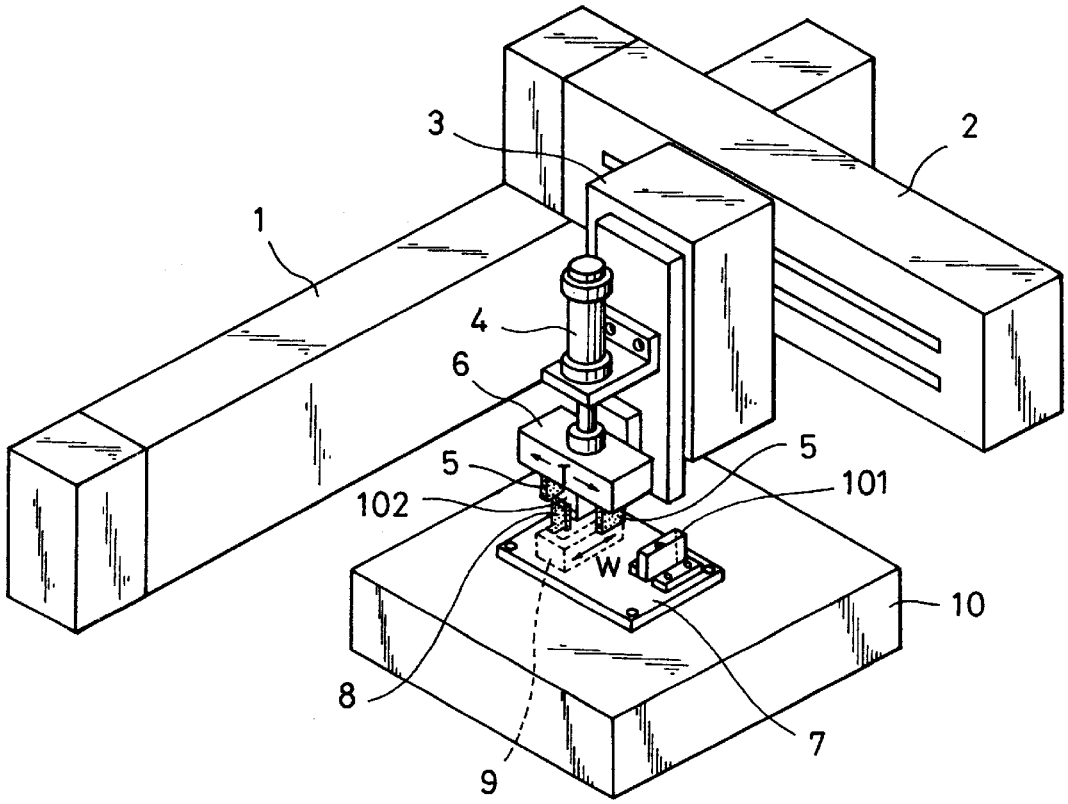
FIG. 1 is a schematic perspective view of an example of a device for inserting an absorber into an accommodating portion according to the present invention.
Figure 2A:
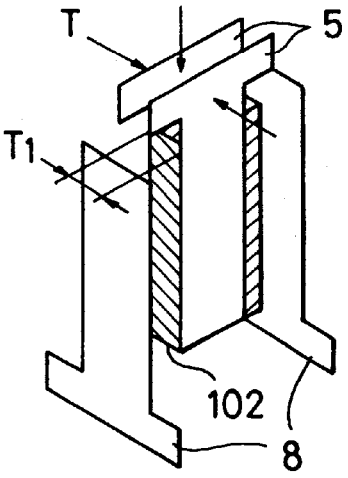
FIGS. 2(*a*) to 2(*h*) are diagrams for illustrating a process of inserting the absorber by utilizing the device of FIG. 1.
Figure 2B:
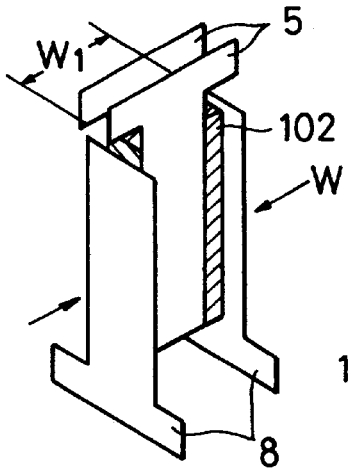
Figure 2C:
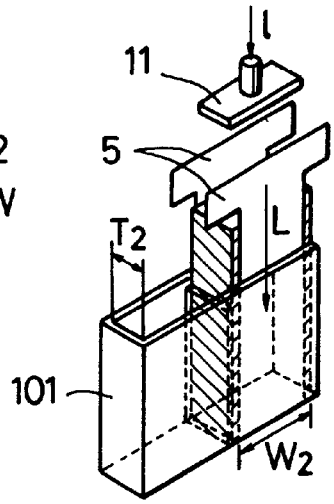
Figure 2D:
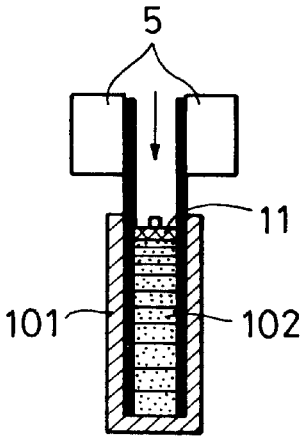
Figure 2E:
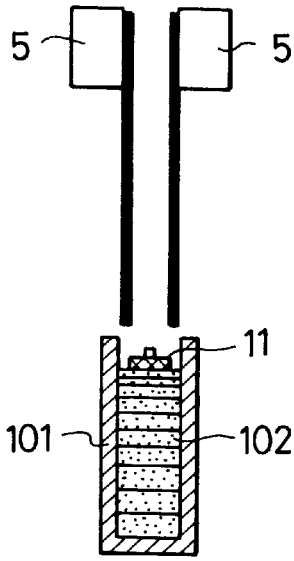
Figure 2F:
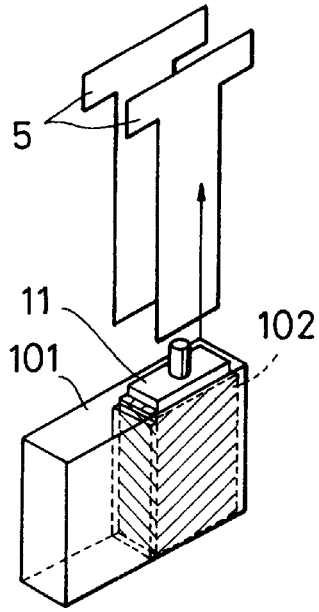
Figure 2G:
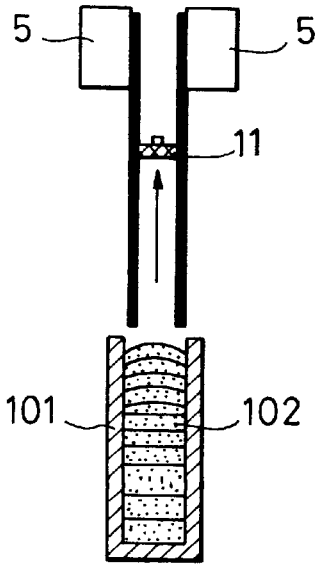
Figure 2H:
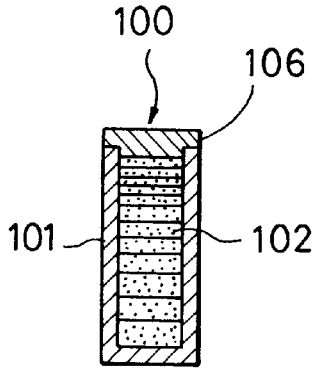

Hereinafter, the preferred embodiments of the present invention will be described in detail by referring to the accompanying drawings.

First Embodiment

This embodiment is a method for inserting an absorber into an ink tank of FIGS. 7(*a*) and 7(*b*), to which the present invention is applied.

FIG. 7(*a*) shows the configuration of a casing 101, which comprises an ink tank 100 and an absorber 102 to be inserted into the ink tank 100. The casing 101 is partitioned by a partition wall 103 into an absorber accommodating portion 101A (which serves as a negative pressure producing material accommodating portion), into which the absorber 102 is inserted, and an ink containing portion 101B into which liquid ink is directly injected. Further, as illustrated in FIG. 7(*b*), an ink supply opening 104, into which an ink supply tube 201 of a recording head RH is inserted, and an air vent 105, through which the inside of the ink tank communicates with the air, are formed in a side part of the absorber accommodating portion 101A into which the absorber 102 is inserted. The casing 101 of FIG. 7(*a*), in which the absorber 102 is inserted, is covered with a lid 106, see FIG. 7(*b*), thus to form the ink tank 100. Incidentally, ink is supplied from the ink containing portion 101B to the absorber 102 through a gap 107, that forms a communication port, between the partition wall 103 and the lid 106. On the other hand, air is introduced from the absorber 102 to the ink containing portion 101B. Additionally, the ink supplied to the absorber 102 is further fed to a head portion through the ink supply tube 201 of the recording head RH. Further, an energy conversion element 202 (namely, a heater in this embodiment) provided at each discharging opening 203 is driven so as to discharge ink from the opening 203 and perform a desired recording. The arrangement of the energy conversion element 202 and discharge opening 203 is shown in detail in FIG. 7(*c*).

The absorber 102 to be inserted into the casing 101 is nearly similar in shape to the absorber accommodating portion 101A and has thickness T, a width W and a length L.

The outside shape of the absorber 102, however, need not be similar to that of the absorber accommodating portion 101A. Namely, the absorber 102 may take various shapes, though the absorber 102 is required to be larger than the absorber accommodating portion 101A. Moreover, a rectangular prism and other polygonal prisms are very preferable for achieving an insertion of the absorber into the portion 101A in such a manner that a part of the absorber, which is in the vicinity of the ink supply opening 104, becomes dense as will be described hereinbelow.

Incidentally, as described above, it is required that the absorber is larger than the absorber accommodating portion 101A. However, there is a preferable range of the size of the absorber, in which a favorable relation between (or distribution of) dense and less-dense (that is, less-compressed) parts thereof can be established and wrinkles or the like do not occur after it is inserted into the absorber accommodating portion. Namely, if the absorber 102 is excessively larger than the absorber accommodating portion 101A, the compression of the absorber 102, which is caused when it is inserted into the absorber accommodating portion 101A, becomes too large, with the result that a wrinkle or the like can occur in the inserted absorber. In contrast, if the absorber 102 is insufficiently larger than the absorber accommodating portion 101A, a desired relation between (or distribution of) dense and less-dense parts thereof is not obtained and the absorber accommodating portion 101A does not sufficiently serve as a negative pressure source. Therefore, in this embodiment, in contrast to the absorber accommodating portion 101A which is about 8 mm in the thickness direction, 21 mm in the width direction and 32.7 mm in the length direction, the absorber 102 is about 19.7 mm thick (T), 23.5 mm wide (W) and 47.0 mm long (L). Or to put it another way, the absorber 102, which typically would have 35 cells per inch, is compressed at approximately a quadruple compression (¼ of its uncompressed size) when inserted in the absorber accommodating portion.

Incidentally, the degree of compression of the absorber 102 is such that a negative pressure applied to the recording head corresponds to a pressure head of about 4 to 6 cmAg, depending on the number of cells of the absorber (or the number of cells per inch thereof) and the diameter of the cells.

FIG. 1 is a schematic perspective view of an absorber inserting device to be used to insert the absorber 102 into the casing 101.

The absorber inserting device consists of arms 1 and 2, a scanning portion 3 fitted to the arm 2 in such a manner as to be able to scan, a cylinder 4 vertically movably secured to the scanning portion 3, a first parallel clamping hand or pressing member 6 fitted to a lower part of the cylinder 4, which has a pair of first fingers or pressing elements 5 for compressing the absorber 102 in the longitudinal direction (indicated by arrows T), a receiving jig 7 provided with a jig for fixing the absorber 102 and the casing 101, a second parallel clamping hand or pressing member 9 provided under the receiving jig 7, which has a pair of second fingers or pressing elements 8 for compressing the absorber 102 in the transverse direction (indicated by arrows W), and a pedestal 10 on which the receiving jig 7 and the second parallel clamping hand 9 are mounted.

A process of inserting the absorber into the casing by using the absorber inserting device of FIG. 1 is schematically shown in FIGS. 2(*a*) to 2(*h*) step by step.

First, the absorber 102 and the casing 101 are securely placed on the receiving jig 7. Then, as illustrated in FIG. 2(*a*), the first fingers 5 fitted to the first parallel clamping hand 6 are moved in the directions of the arrows T, respectively, so as to compress the absorber 102. At that time, the absorber is compressed until the thickness of the compressed absorber becomes equal to $T_1$ which is shorter than the corresponding dimension $T_2$ of the absorber accommodating portion of the casing 101.

Subsequently, as illustrated in FIG. 2(*b*), the second fingers 8 fitted to the second parallel clamping hand 9 are moved in the directions of the arrows W, respectively, so as to further compress the absorber 102 in such directions, which has been already compressed in the directions of the arrows T. This time, the absorber is further compressed until the width thereof becomes equal to $W_1$ which is narrower than the corresponding dimension $W_2$ of the absorber accommodating portion of the casing 101.

Thereafter, the absorber 102 compressed as illustrated in FIG. 2(*b*) is released from the compression which has been caused by the second fingers 8 by lifting the cylinder 4 then causing the scanning portion 3 to scan. Thereby, the absorber 102 held by the first hand fingers 5 is moved bodily to a position just above the casing 101. Subsequently, as illustrated in FIG. 2(*c*), the cylinder 4 is lowered in the direction of an arrow L so as to insert the absorber into the casing 101. Thus, the absorber 102, which is being held by the first fingers 5, is inserted into the accommodating portion of the casing.

After inserting the absorber 102 into the casing, a push piece or third pressing member 11 is pushed down (in the direction of an arrow l) against the absorber 102 from between the first fingers 5. Thereby, as illustrated in FIG. 2(*d*), the absorber 102 is compressed and inserted wholly into the casing 101.

The absorber 102 pushed into the casing 101 by the push piece 11 in this way is inserted therein such that an upper part thereof in contact with the push piece 11 is placed into a dense state and conversely, a lower part thereof is put into a less-dense state. (In these figures, the spacing between the horizontal lines drawn on the absorber represent a density gradient, with lines that are closer together indicating a higher density due to greater compression of the absorbing member.)

Then, as illustrated in FIG. 2(*e*), the first fingers 5 are withdrawn from the casing 101 (which is secured firmly to the receiving jig) by lifting up the cylinder 4 without moving the push piece 11. (FIG. 2(*f*) is a perspective view of the device of FIG. 2(*e*).)

Next, the push piece 11 is lifted up as illustrated in FIG. 2(*g*). Then, an opening of the casing 101 is covered with the lid 106, as shown in FIG. 2(*h*). Thereby, the ink tank 100 is completed.

Thus, in the ink tank 100 the absorber 102 is in a state in which wrinkles and unnecessary space are not formed therein and the density increases toward the ink supply opening. Consequently, the supply of ink is smoothly performed and favorable printing can be achieved.

Second Embodiment

Figure 3A:
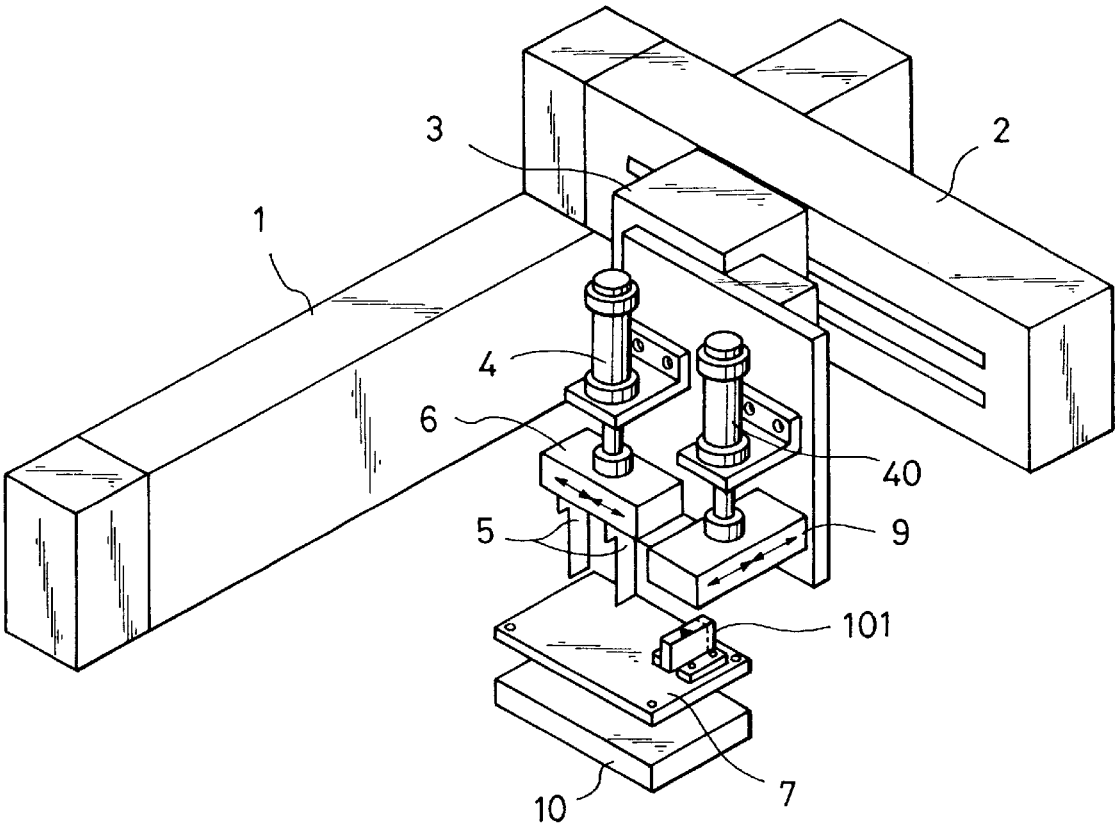
FIGS. 3(*a*) and 3(*b*) are schematic perspective views of another embodiment of the device for inserting an absorber into an accommodating portion according to the present invention.
Figure 3B:
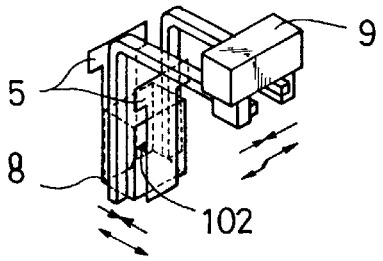
Figure 4A:
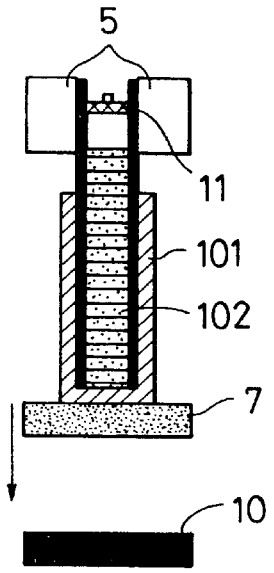
FIGS. 4(*a*) to 4(*i*) are diagrams for illustrating a process of inserting the absorber by utilizing the device of FIG. 3.
Figure 4B:
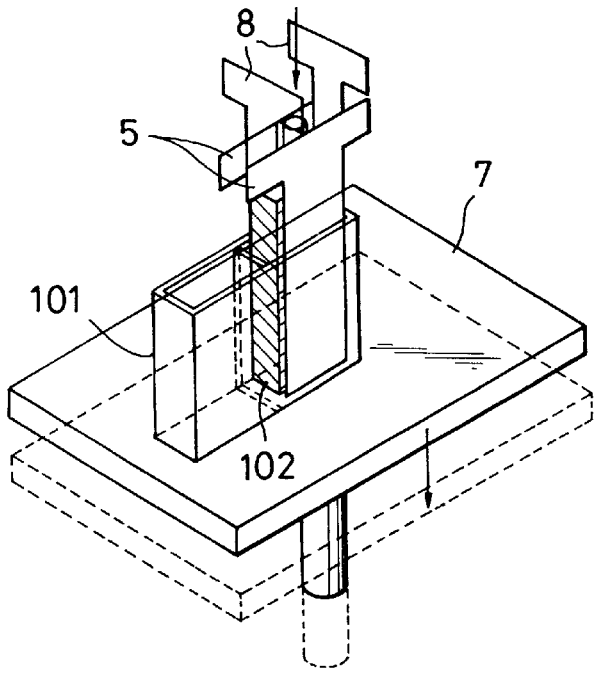
Figure 4C:
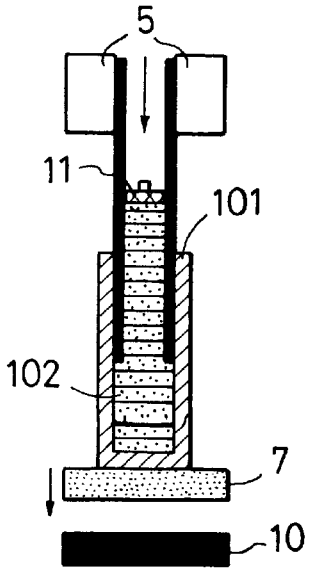
Figure 4D:
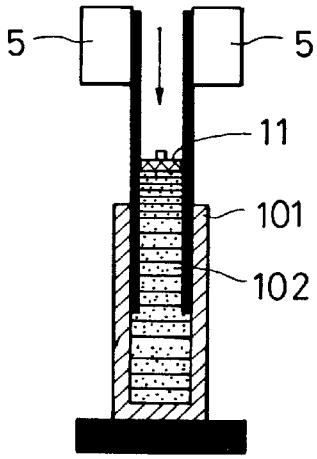
Figure 4E:
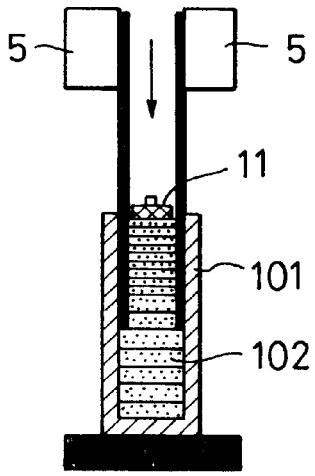
Figure 4F:
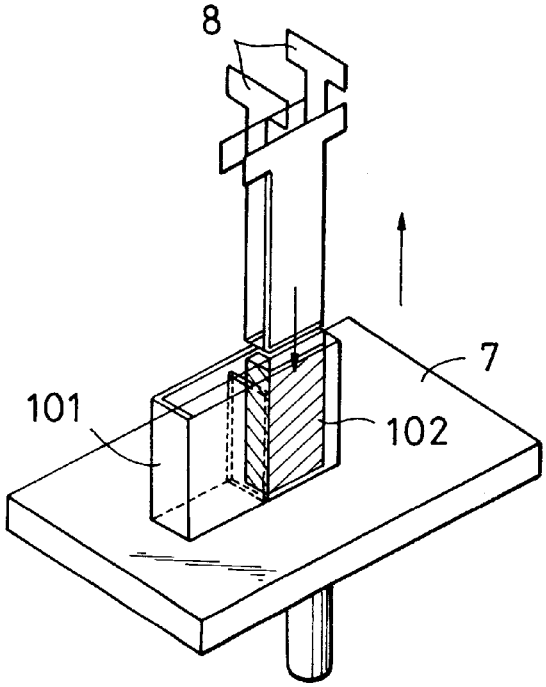
Figure 4G:
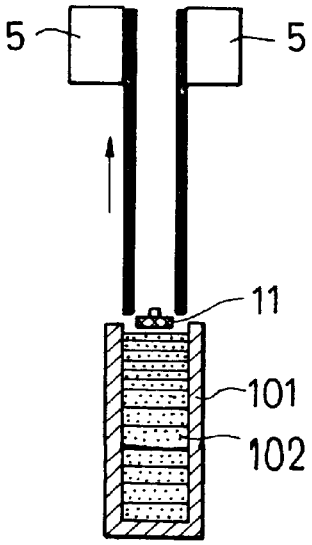
Figure 4H:
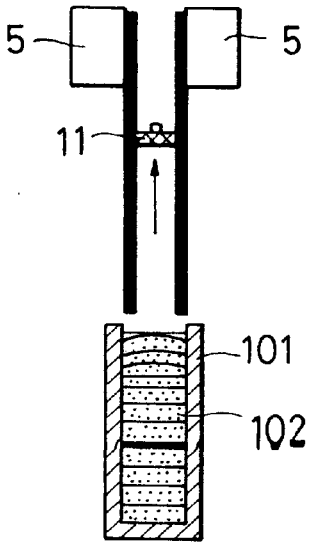
Figure 4I:
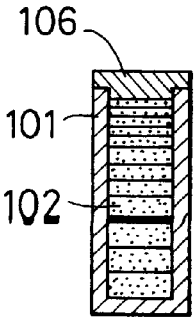

In the case of this embodiment, as illustrated in FIG. 3(*a*), the receiving jig 7 is not fixed to the pedestal 10 and is adapted to move vertically, differently from the absorber inserting device of the foregoing embodiment. Further, the second fingers 8 and the second parallel clamping hand 9 are secured to the scanning portion 3 through a cylinder 40, correspondingly to the difference in configuration between the first and second embodiments.

FIG. 3(*b*) illustrates the configuration of only the second fingers 8, the second parallel clamping hand 9 and the first fingers 5. As shown in this figure, the second fingers 8 are connected to the second parallel clamping hand 9 through L-shaped guide members, respectively.

FIGS. 4(*a*) to 4(*h*) illustrate a process of inserting the absorber 102 into the casing 101 by using such a device.

First, the absorber 102 is compressed by using the first fingers 5, which are fitted to the first parallel clamping hand 6, and the second fingers 8, which are fitted to the second parallel clamping hand 9, in such a manner as to be able to be inserted into the absorber accommodating portion of the casing 101. Thereafter, the cylinders 4 and 40 are lifted and the scanning portion 3 is operated to scan. Thereby, the absorber 102 is moved to a position just above the casing 101. Further, as shown in FIGS. 4(*a*) and 4(*b*), the compressed absorber is inserted together with the first and second fingers 5 and 8 into the casing 101 by lowering the cylinders 4 and 40.

Thereafter, as illustrated in FIG. 4(*c*), the receiving jig 7 is lowered to the pedestal 10 together with the casing 101 by pushing down the absorber in the direction of an arrow by means of the push piece 11 from above until the receiving jig 7 touches the pedestal 10, with the first and second fingers kept fixed. Thereby, the absorber compressed and held by the first and second fingers is pushed out into the casing therefrom. Thereafter, as shown in FIGS. 4(*d*) and 4(*e*), the push piece 11 is further pushed down in the direction of the arrow so as to insert the absorber into the casing. Thereby, a certain region of the absorber, determined by the distance between the receiving jig 7 and the pedestal 10 (see FIG. 4(*a*)), is surrounded by the first and second fingers, and accordingly is more dense in comparison with the other part of the absorber, which is not surrounded by the fingers.

Then, as illustrated in FIGS. 4(*f*) and 4(*g*), only the first and second fingers are lifted up in the direction of an arrow and are thus detached from the absorber 102 in which dense and less-dense parts are distributed as shown by the density-gradient lines. Thereafter, the push piece 11 is lifted up (FIG. 4(*h*)) and the opening of the casing 101 is covered with the lid 106 (FIG. 4(*i*)). Thus, the ink tank 100 is completed.

The denser region of the absorber can be regulated by performing a relative position adjustment of the first and second fingers, the receiving jig and the pedestal.

Other Embodiments

Figure 5:
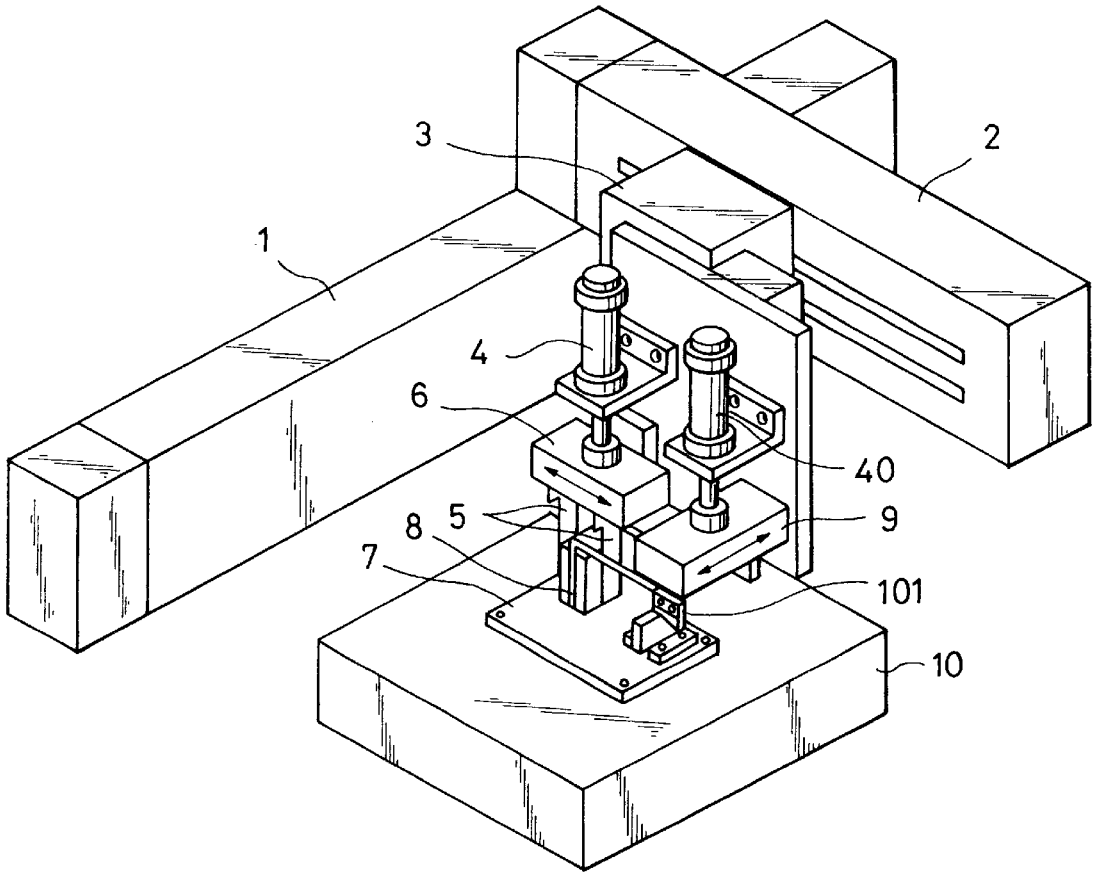
FIG. 5 is a schematic perspective view of a further embodiment of the device for inserting an absorber into an accommodating portion according to the present invention.
Figure 6:
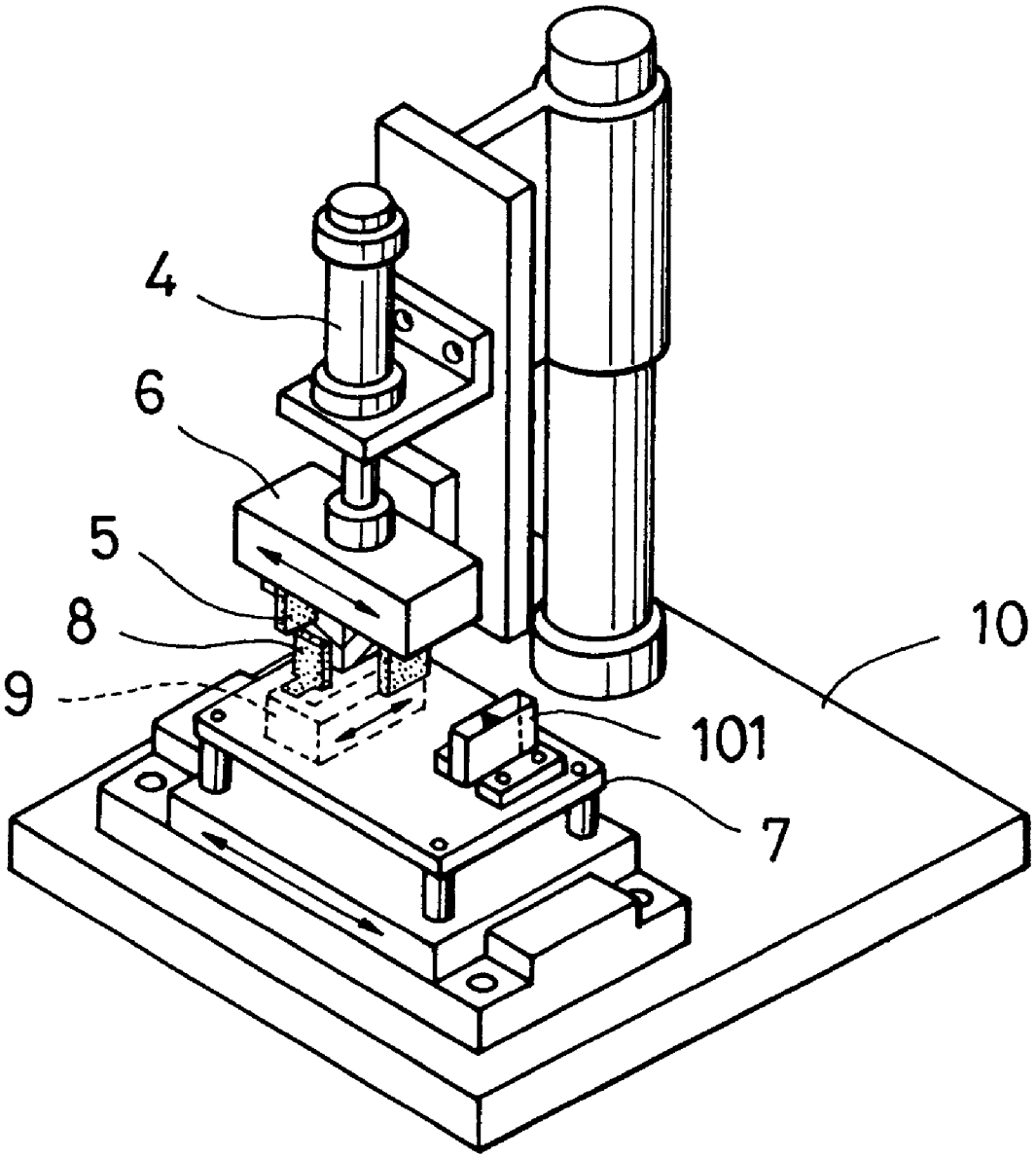
FIG. 6 is a schematic perspective view of still another embodiment of the device for inserting an absorber into an accommodating portion according to the present invention.

Other devices configured as illustrated in FIGS. 5 and 6 may be used as the device for inserting the absorber 102 into the casing 101 according to the present invention.

The configuration of the device of FIG. 5 is obtained by fixing the receiving jig 7 to the pedestal of the device of FIG. 3. In the case of the device of FIG. 5, although the range of the dense region of the absorber 102 can not be regulated as readily as in the FIG. 3 device, dense and less-dense regions can be appropriately generated in the absorber by using the push piece.

Moreover, the configuration of the device of FIG. 6 is obtained by removing the scanning portion 3 fitted to the arm 2 of the device of FIG. 1 to enable the receiving jig 7 to move or scan. In the case of employing the configuration of FIG. 6, the size of the device can be reduced.

When inserting the absorber into the casing of the ink tank by using the foregoing device, the inserted absorber can be put into a state in which the aforementioned distribution of dense and less-dense parts is generated therein and local gaps and wrinkles do not occur therein. An ink jet cartridge illustrated in FIG. 7(*b*) can be constituted by fitting the recording head to such an ink tank.

In this ink jet cartridge, the density becomes high in that part of the absorber which is close to the ink supply opening 104. Therefore, the ink supply can be stabilized. Moreover, a secure and good ink supply state can be maintained.

Incidentally, a plurality of elastic bodies can be simultaneously compressed and inserted into the casing in a same operation by using the parallel clamping hands.

Moreover, a desired distribution of dense and less-dense parts can be easily generated by changing the materials of the surfaces of the fingers of the parallel clamping hands, which are in contact with the elastic bodies, or regulating the surface roughness of the surfaces thereof to change their coefficient of friction with the absorber.

Needless to say, the method of this embodiment for inserting the absorber into the casing can be applied to an ink tank of the type such that the absorber inserted into the entire ink tank.

The ink tank 100 with the aforementioned configuration is filled and replenished with ink as follows.

Namely, an ink injection port 108 for an initial ink filling is bored in the lid 106 of the completed ink tank 100. Further, the ink tank 100 is filled with ink from the ink injection port 108 by means of ink filling equipment. Upon completion of the filling operation, the ink injection port 108 is stopped up by inserting a spherical plug 109 thereinto.

Hereinafter, a method of filling the ink tank with ink will be briefly described.

Figure 8A:
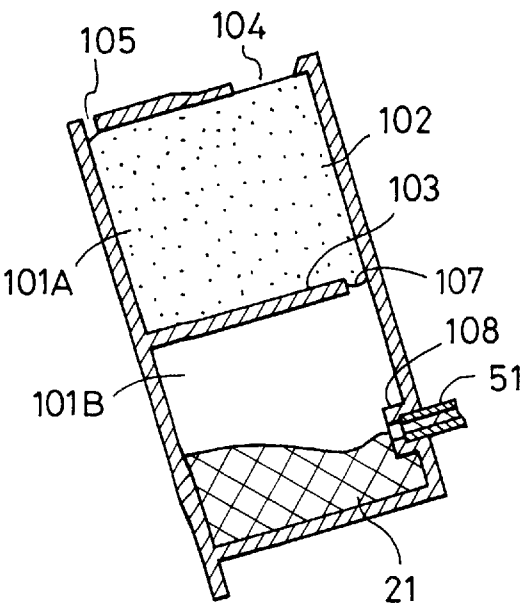
FIGS. 8(*a*) to 8(*c*) are diagrams for illustrating a process of filling an ink tank with ink.
Figure 8B:
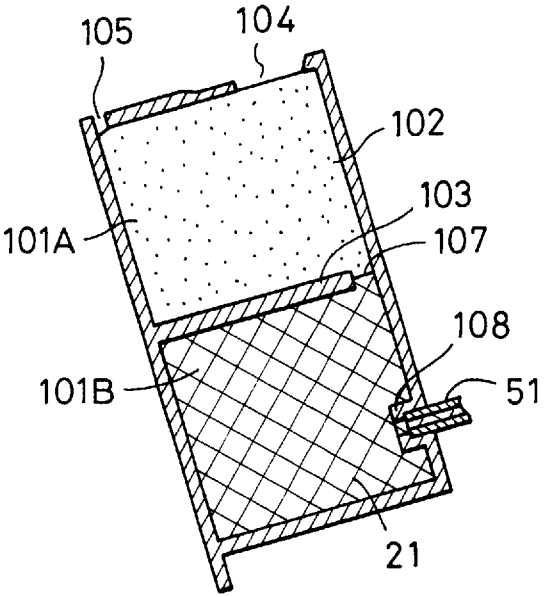
Figure 8C:
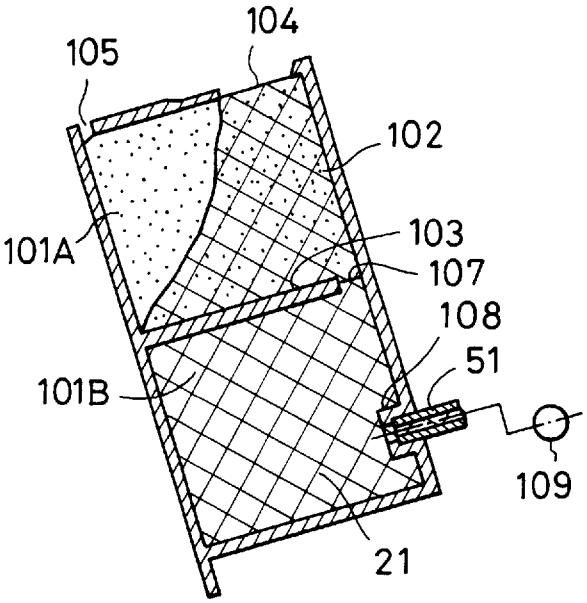

As shown in FIG. 8(*a*), in the ink injection in this embodiment, when the ink is injected, the ink containing portion 101B is oriented to be at a bottom position in a manner such that the communication gap 107 with the material accommodating portion 101A takes a top position.

FIG. 8(*a*) shows an initial stage after the start of injection of ink 21 (shown as cross-hatching in the figures), which injection is started after an ink supply member 51 of an unshown ink injector is inserted through the ink injection port 108 of the ink cartridge.

An outer peripheral portion of an end of the ink supply member 51 is of elastic material, and is contacted to the ink injection portion 108 to seal it. Because the ink cartridge is inclined such that the gap 107 takes a topmost position with respect to the ink containing portion 101B, the air in the portion 101B is easily moved into the material accommodating portion 101A along the partition wall 103 as the ink is injected.

When the inside air can be easily moved, the ink cartridge is not necessarily inclined, but may be placed with the topmost surface of the ink containing portion at the same level as the gap while the ink is injected.

By injecting the ink in the above-described manner, the ink injection can be performed without air bubbles remaining in the ink accommodating portion when the ink injection into the ink containing portion 101B has been completed, as shown in FIG. 8. By continuing the ink injection, the ink will be supplied into the material accommodating portion 101A, as shown in FIG. 8. By this injection procedure, the presence of air bubbles in the ink containing portion can be prevented, and in addition, the presence of the ink in the communication path between the gap 107 and the opening 104 in the negative pressure producing material accommodating portion 101A can be assured. Therefore, the stability of the ink supply to the recording head is also assured.

Figure 9:
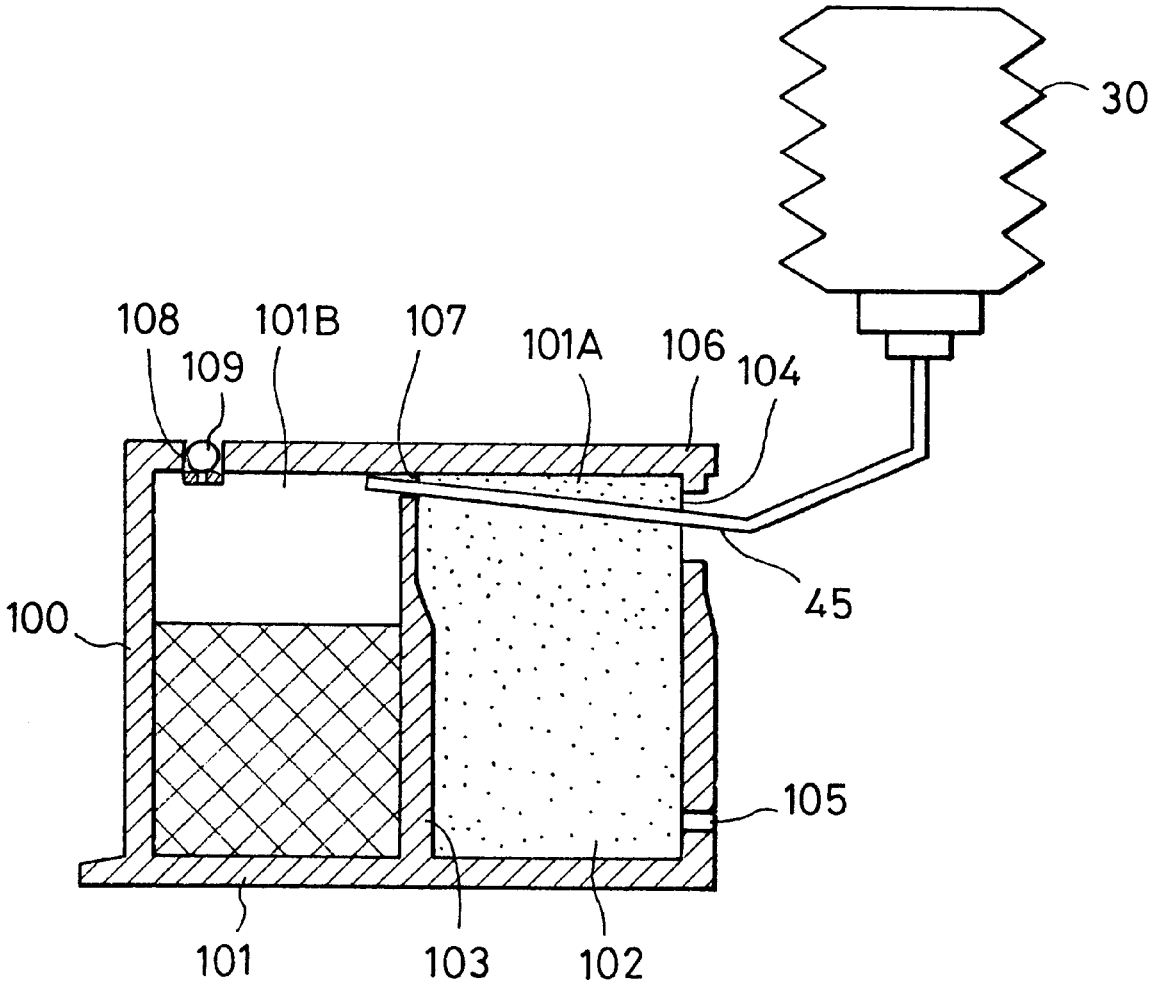
FIG. 9 is a schematic diagram for illustrating yet another device for filling an ink tank with ink according to the present invention.

Similarly to the foregoing embodiment, the ink cartridge used up or partly used from the ink containing portion 101B is placed so that the gap 107 takes the topmost position. Then, an ink supply tube 45 is inserted through the opening 104 and through the negative pressure producing material 102 and through the gap 107 into the ink containing portion 101B, in the embodiment shown in FIG. 9. Using an ink refilling container 30, the ink is directly injected into the ink containing portion 101B. The ink refilling container 30 is provided with a pumping function to force the ink into the ink containing portion 101B. In the example of FIG. 9, the container has bellows to permit pressure injection.

In accordance with the present invention, the distribution of dense and less-dense parts can be generated easily and securely in the absorber inserted in the ink tank. Consequently, the present invention can provide a method for inserting an absorber in an ink tank, by which an ink tank containing an absorber, the distribution of dense and less-dense parts of which is suitable for improving ink supply capability, can be produced.

Although the preferred embodiments of the present invention have been described above, it should be understood that the present invention is not limited thereto and that other modifications will be apparent to those skilled in the art without departing from the spirit of the invention.

The scope of the present invention, therefore, is to be determined solely by the appended claims.

What is claimed is:

1. A method of producing an ink tank having a case containing an absorber wherein the absorber is compressed and accommodated in the case, said case having an absorber accommodating portion with a capacity smaller than the absorber and having an open upper side for permitting insertion of the absorber into the absorber accommodating portion, the method comprising the steps of:

compressing a first set and a second set of opposite side surfaces of the absorber with a first pressing member and a second pressing member, respectively, each pressing member including opposing pressing elements for compressing corresponding opposite side surfaces of the absorber to dimensions smaller than corresponding dimensions of the case;

inserting the absorber compressed by the first pressing member and the second pressing member together with at least one of said pressing members into an accommodating portion of the case from above the open upper side of the case;

thereafter pressing another side surface of the absorber with a third pressing member to insert the absorber wholly within the case;

withdrawing said inserted ones of said first and second pressing members inserted into the case in said inserting step out of the case while the third pressing member holds the absorber in the case; and withdrawing the third pressing member and covering the open upper side of the case with a cover member so as to seal the ink tank tightly.

2. A method according to claim 1, further comprising the step of injecting ink into the ink tank.

3. A method according to claim 1, further comprising the step of releasing compression of one of the first set and the second set of side surfaces of the absorber before said inserting step.

4. A method according to claim 1, wherein:

said compressing step comprises first compressing the first set of opposite side surfaces of the absorber and then compressing the second set of opposite side surfaces of the absorber; and compression of the second set of opposite side surfaces is released before said inserting step.

5. A method according to claim 4, wherein said inserting step comprises inserting the absorber compressed by the first and second pressing members together with the first pressing member into the absorber accommodating portion of the case.

6. A method according to claim 1, wherein:

in said inserting step both of said first and second pressing members are inserted at least partly into the accommodating portion of the case, and after said inserting step a portion of the absorber remains outside of the case; and the absorber slides along the opposing pressing elements of the first pressing member and the second pressing member in said pressing step until the absorber is wholly within the case.

7. A method according to claim 6, wherein the absorber is elastically compressible and a density of the absorber decreases with increasing distance from the side surface pressed by the third pressing member.

8. A method according to claim 7, wherein the pressing elements of the first pressing member and the second pressing member have coefficients of friction with the absorber that provide a predetermined density gradient in the absorber that provide a predetermined density gradient in the absorber.

9. A method according to claim 1, wherein:

after said inserting step at least a portion of the absorber remains outside the case; and in said pressing step the third pressing member bodily moves the case and the absorber relative to the first pressing member and the second pressing member to partially withdraw the pressing elements from the case, after which the third pressing member continues pressing the other side surface of the absorber to insert the absorber wholly within the case.

10. A method according to claim 9, wherein the absorber is elastically compressible and the density of the absorber decreases with increasing distance from the side pressed by the third pressing member.

11. A method according to claim 10, wherein the pressing elements of the first pressing member and the second pressing member have coefficients of friction with the absorber that provide a predetermined density gradient in the absorber.

12. A method according to claim 1, wherein said inserting step comprises inserting a compressed unit comprised of the absorber compressed by the first pressing member and the second pressing member together with the first pressing member and the second pressing member, the compressed unit being inserted into the absorber accommodating portion of the case.

13. A method of producing an ink tank for storing ink supplied to an ink jet head, the method comprising the steps of:

providing a case for the ink tank, the case comprising an absorber accommodating chamber for accommodating an absorber and provided with an air vent for communication with ambient air and an ink chamber which is substantially closed except for a liquid communication part for communication with the absorber accommodating chamber wherein the ink chamber contains a reservoir of ink to be supplied to the absorber accommodating chamber, further the ink chamber being united with the absorber accommodating chamber, and wherein the case has an open upper side;

compressing a first set and a second set of opposite side surfaces of the absorber with a first pressing member and a second pressing member, respectively, each pressing member including opposing pressing elements for compressing corresponding opposite side surfaces of the absorber to dimensions smaller than corresponding dimensions of the case;

inserting the absorber compressed by the first pressing member and the second pressing member together with at least one of said pressing members into the accommodating chamber of the case from above the open upper side of the case;

thereafter pressing another side surface of the absorber with a third pressing member to insert the absorber wholly within the case;

withdrawing said inserted ones of said first and second pressing members inserted into the case in said inserting step out of the case while the third pressing member holds the absorber in the case; and withdrawing the third pressing member and covering the open upper side of the case with a cover member so as to seal the ink tank tightly.

14. A method according to claim 13, further comprising the step of injecting ink into the ink tank.

15. A method according to claim 13, further comprising the step of releasing the compression of one of the first set and the second set of side surfaces of the absorber before said inserting step.

16. A method according to claim 13, wherein:

said compressing step comprises first compressing the first set of opposite side surfaces of the absorber and then compressing the second set of opposite side surfaces of the absorber; and the compression of the second set of opposite side surfaces is released before said inserting step.

17. A method according to claim 16, wherein said inserting step comprises inserting the absorber compressed by the first pressing member and the second pressing member together with the first pressing member into the absorber accommodating portion of the case.

18. A method according to claim 13, wherein:

in said inserting step both of said first and second pressing members are inserted at least partly into the accommodating chamber of the case, and after said inserting step a portion of the absorber remains outside of the case; and the absorber slides along the opposing pressing elements of the first pressing member and the second pressing member in said pressing step until the absorber is wholly within the case.

19. A method according to claim 18, wherein the absorber is elastically compressible and the density of the absorber decreases with increasing distance from the side surface pressed by the third pressing member.

20. A method according to claim 19, wherein the pressing elements of the first pressing member and the second pressing member have coefficients of friction with the absorber that provide a predetermined density gradient in the absorber.

21. A method according to claim 13, wherein:

after said inserting step at least a portion of the absorber remains outside the case; the in said pressing step the third pressing member bodily moves the case and the absorber relative to the first pressing member and second pressing member to partially withdraw the pressing elements from the case, after which the third pressing member continues pressing the other side surface of the absorber to insert the absorber wholly within the case.

22. A method according to claim 21, wherein the absorber is elastically compressible and the density of the absorber decreases with increasing distance from the side surface pressed by the third pressing member.

23. A method according to claim 22, wherein the pressing elements of the first pressing member and the second pressing member have coefficients of friction with the absorber that provide a predetermined density gradient in the absorber.

24. A method according to claim 13, wherein said inserting step comprises inserting a compressed unit comprised of the absorber compressed by the first pressing member and the second pressing member together with the first pressing member and the second pressing member, the compressed unit being inserted into the absorber accommodating portion of the case.

25. A method of producing an ink tank for storing ink supplied for an ink jet head, the method comprising the steps of:

compressing surfaces of an absorber with pressing members, said pressing members each including opposing pressing elements for compressing corresponding side surfaces of the absorber to dimensions smaller than corresponding dimensions of an ink absorbing member holding member for the tank;

inserting the absorber compressed by the pressing members together with the pressing members into an accommodating portion of the ink absorbing member holding member from above the holding member, the ink absorbing member holding member having an upper side with an opening for inserting the absorber therein;

thereafter pressing another side surface of the absorber with another pressing member to insert the absorber wholly within the ink absorbing member holding member;

withdrawing the pressing members out of the accommodating portion while the other pressing member holds the absorber in the ink absorbing member holding member; and withdrawing the other pressing member and covering the opening of the ink absorbing member holding member with a cover member so as to seal the ink tank tightly.

26. A method according to claim 25, further comprising the step of injecting ink into the ink tank.

27. A method according to claim 25, wherein:

after said inserting step a portion of the absorber remains outside of the ink absorbing member holding member; and the absorber slides along opposing pressing elements of the pressing members in said pressing step until the absorber is wholly within the ink absorbing member holding member.

28. A method according to claim 27, wherein the absorber is elastically compressible and a density of the absorber decreases with increasing distance from the side surface pressed by the another pressing member.

29. A method according to claim 28, wherein the pressing elements of the pressing members have coefficients of friction with the absorber that provide a predetermined density gradient in the absorber.

30. A method according to claim 25, wherein:

after said inserting step at least a portion of the absorber remains outside the ink absorbing member holding member; and in said pressing step the other pressing member bodily moves the ink absorbing member holding member and the absorber relative to the pressing members to partially withdraw the pressing members from the ink absorbing member holding member, after which the other pressing member continues pressing the other side surface of the absorber to insert the absorber wholly within the ink absorbing member holding member.

31. A method according to claim 30, wherein the absorber is elastically compressible and density of the absorber decreases with increasing distance from the side surface pressed by the other pressing member.

32. A method according to claim 31, wherein the pressing elements of the pressing members have coefficients of friction with the absorber that provide a predetermined density gradient in the absorber.

33. A method of producing an ink tank for storing ink supplied for an ink jet head, the method comprising the steps of:

compressing surfaces of an absorber with pressing members, said pressing members each including opposing pressing elements for compressing the absorber to dimensions smaller than corresponding dimensions of an ink tank case for the ink tank;

inserting the absorber compressed by the pressing members together with the pressing members into an accommodating portion of the ink tank case from above the ink tank case, the ink tank case having an upper side with an opening for inserting the absorber therein;

thereafter pressing another side surface of the absorber with another pressing member to insert the absorber wholly within the case;

withdrawing the pressing members out of the case while the other pressing member holds the absorber in the ink tank case; and withdrawing the other pressing member and covering the opening of the ink tank case with a cover member to seal the ink tank tightly.

34. A method according to claim 33, further comprising the steps of injecting ink into the ink tank.

35. A method according to claim 33, wherein the pressing members comprise a first pressing member and a second pressing member for compressing opposing side surfaces of the absorber, respectively.

36. A method according to claim 35, wherein:

after said inserting step a portion of the absorber remains outside of the case; and the absorber slides along the opposing pressing elements of the first pressing member and the second pressing member in said pressing step until the absorber is wholly within the case.

37. A method according to claim 36, wherein the absorber is elastically compressible and the density of the absorber decreases with increasing distance from the side surface pressed by the other pressing member.

38. A method according to claim 37, wherein the pressing members have coefficients of friction with the absorber that provide a predetermined density gradient in the absorber.

39. A method according to claim 35, wherein:

after said inserting step at least a portion of the absorber remains outside the case; and in said pressing step the other pressing member bodily moves the case and the absorber relative to the pressing members to partially withdraw the pressing members from the case, after which the other pressing member continues pressing the other side surface of the absorber to insert the absorber wholly within the case.

40. A method according to claim 39, wherein the absorber is elastically compressible and the density of the absorber decreases with increasing distance from the side surface pressed by the other pressing member.

41. A method according to claim 40, wherein the pressing members have coefficients of friction with the absorber that provide a predetermined density gradient in the absorber.

* * * * *

UNITED STATES PATENT AND TRADEMARK OFFICE

CERTIFICATE OF CORRECTION

PATENT NO. : 6,231,171 B1
DATED : May 15, 2001
INVENTOR(S) : Takashi Yamashita et al.

It is certified that error appears in the above-identified patent and that said Letters Patent is hereby corrected as shown below:

Column 1,
Line 59, “of the” should be deleted.

Column 2,
Line 43, “such” should read -- such a --.

Column 4,
Line 14, “detail” should read -- detailed --.

Column 6,
Line 35, “represent” should read -- represents --.
Line 61, “correspondingly” should read -- corresponding --.

Column 7,
Line 47, “can not” should read -- cannot --.

Column 8,
Line 12, “inserted” should read -- is inserted --.

Column 9,
Line 51, “tank tightly.” should read -- tank. --.

Column 10,
Line 22, “absorber that provide a predetermined density gradient in the” should read -- absorber. --.
Line 23, “absorber.” should be deleted.

Colum 11,
Line 19, “tank tightly.” should read -- tank. --.
Line 60, “case; the” should read -- case; and --.

Column 12,
Line 42, “tank tightly.” should read -- tank. --.
Line 56, “another” should read -- other --.

UNITED STATES PATENT AND TRADEMARK OFFICE

CERTIFICATE OF CORRECTION

PATENT NO. : 6,231,171 B1
DATED : May 15, 2001
INVENTOR(S) : Takashi Yamashita et al.

It is certified that error appears in the above-identified patent and that said Letters Patent is hereby corrected as shown below:

Column 13,
Line 37, “tank tightly.” should read -- tank. --.

Signed and Sealed this

Fourth Day of February, 2003

JAMES E. ROGAN
*Director of the United States Patent and Trademark Office*